US005722244A

United States Patent [19]

Shelton

[11] Patent Number: 5,722,244

[45] Date of Patent: Mar. 3, 1998

[54] MODULAR ICE CUBE MAKER AND METHOD OF MANUFACTURE

[75] Inventor: Norman L. Shelton, Boulder, Colo.

[73] Assignee: Mile High Equipment Co., Denver, Colo.

[21] Appl. No.: 534,352

[22] Filed: Sep. 27, 1995

[51] Int. Cl.[6] ..... F25C 1/12

[52] U.S. Cl. ..... 62/74; 62/298; 62/352

[58] Field of Search ..... 62/74, 347, 298, 62/352

[56] References Cited

U.S. PATENT DOCUMENTS

| | | | |
|---|---|---|---|
| 3,009,336 | 11/1961 | Bayston et al. | 62/347 |
| 3,019,612 | 2/1962 | Jaeger | 62/347 |
| 3,021,686 | 2/1962 | Alt | 62/347 |
| 3,289,430 | 12/1966 | Dedricks et al. | 62/347 |
| 3,913,349 | 10/1975 | Johnson | 62/352 |
| 4,100,764 | 7/1978 | Murano | 62/298 |
| 4,458,503 | 7/1984 | Nelson | 62/347 |
| 5,042,263 | 8/1991 | Day et al. | 62/74 |
| 5,345,782 | 9/1994 | Takahashi et al. | 62/347 |

*Primary Examiner*—William E. Tapolcai

*Attorney, Agent, or Firm*—Ohlandt, Greeley, Ruggiero & Perle

[57] ABSTRACT

An ice cuber and method for manufacturing the same that is constructed of plastic panels, in which instructions, blind fastener holes, a fan shroud, and a water trough are all molded into the panels. Some of the panels are permanently attached to each other by unicore welding. The cuber contains an isolated but accessible dry compartment so that components located therein will not suffer from the splashing water generated by ice cubers.

39 Claims, 4 Drawing Sheets

MODULAR ICE CUBE MAKER AND METHOD OF MANUFACTURE

FIELD OF INVENTION

This invention relates to the field of ice cube making machines. In particular, it relates to an ice cube making machine that has a modular structure, that utilizes a plastic frame, and that is internally divided into a wet and a dry side. Additionally, the ice cube maker is manufactured using the techniques of blowmolding, rotocasting, unicore welding, and blind hole fastening. Certain features, such as the fan shroud, water through, and selected operating instructions, are molded into the plastic components of the ice cube maker.

BACKGROUND OF THE INVENTION

Two common types of ice making machines exist: household units that are combined with refrigerators, and commercial units that are used by restaurants, bars, hospitals, hotels, and other establishments that require large amounts of ice. Commercial units may produce either flaked or cubed ice.

Commercial ice cube makers operate by dripping water over a frozen mold which is composed of an array of individual cube compartments. Some of the dripping water adheres to the mold and freezes into cubes, while some of the water drips off of the mold into a water trough on the bottom of the ice cube maker and is recirculated to be applied again to the mold. When the ice cube maker senses that the mold is substantially full of ice cubes, it harvests the cubes by releasing them from the mold using the heat of a compressed refrigerant and depositing the cubes into an insulated storage bin located beneath the ice cube maker.

The ice cube mold is frozen by its proximity to the evaporator of a standard refrigeration circuit. A refrigerant gas is compressed inside a network of closed tubes. The refrigerant is then cooled by directing either water or air across the tubes. The cooling phase occurs when the refrigerant is expanded by passing it through an expansion valve. The reduction in the pressure of the refrigerant causes a concomitant reduction in its temperature. The tubes that hold the expanded, cooled refrigerant, called evaporator tubes, pass through or adjacent to the ice cube mold, generally by means of attaching the mold to a metallic plate called an evaporator plate which is in turn attached to the evaporator tubes. The tubes lead from the ice cube mold to the compressor and the cycle repeats.

The harvesting phase of the ice cube maker occurs when the ice cubes are transferred from the mold to the storage bin. The harvesting phase may be initiated in several ways. A mechanical probe may be used to sense when the mold is full of ice. Alternatively, a timer may be used to set the time of the freezing cycle. A timer has the advantages of low cost and reliability but the disadvantage of reduced accuracy, because the length of time needed to complete a freezing cycle is determined in part by the varying ambient temperature of the cuber. When harvesting occurs before a mold is completely frozen, the cubes will not be fully formed. When harvesting is delayed for a time after the mold is completely frozen, .energy is wasted and the cuber is not producing cubes at its full capacity.

Harvesting is accomplished by allowing hot compressed gas to pass directly into the evaporator, so that the ice cube mold is warmed and the cubes are slightly thawed. As with the freezing cycle, inefficiencies result when the warming cycle lasts either too long or not long enough. The mold is positioned so that gravity pulls the thawed cubes out of the mold and into the storage bin positioned below the ice cube maker. A mechanical agitator or probe may also be used to dislodge the cubes from the mold. The storage bin is equipped with a level sensor so that the cuber will suspend production if the bin becomes full. The control of the freezing and thawing cycles in an ice maker is generally accomplished electronically, such as with a microprocessor.

As the quality of ice cubes produced does not significantly vary, ice cube makers compete commercially on the basis of price, efficiency, and reliability. A problem faced by many ice cube makers is that of corrosion. Ice cube maker housings are traditionally made of metal which eventually corrodes due to water splashing about the interior of the machine when water is dripped onto the mold and when the cubes are released from the mold during the harvesting operation, and also due to the humidity that results from the continuous presence of liquid water in the machine. Internal components of the ice cube maker exposed to the splashing water and the humidity also suffer from corrosion. Electronic components face the additional hazard of short circuiting in this watery environment. Another problem ice makers face is the difficulty of servicing. Ideally, the refrigeration components and the control electronics should be isolated from the splashing water and humidity of the ice maker yet still allow easy access for repair. Servicing and operation instructions should be readily available to the operators and servicing technicians.

In general, superior reliability and manufacturing costs will result when an ice cube maker has as few constituent parts as are necessary and when the constituent parts may be manufactured in as few steps as possible. Of course, the ice maker must be strong enough to provide years of service in commercial environments. The constituent parts of the ice maker body should be solidly joined together with waterproof connections.

SUMMARY OF THE INVENTION

The present invention is a self-contained ice cube maker which manufacturers ice cubes and deposits the cubes into a separate storage bin. In a preferred embodiment, the means for manufacturing the ice cubes are housed in a plastic frame and enclosure including six substantially rectangular panels. Five of the panels form the exterior of the ice maker and the sixth panel divides the interior of the ice maker into two main compartments.

One of these two main compartments may be termed the "dry" compartment, which contains most of the refrigeration circuit with the exception of the evaporator. Specifically, this includes at least the compressor, condenser, and expansion valve. The dry compartment also contains the water pump and the control electronics. The dry compartment is opposite the compartment in which ice is formed and constitutes the back of the ice maker.

The compartment of the ice maker separated from the dry compartment by the dividing panel may be termed the "wet" compartment. The wet compartment is partially bounded by the front panel of the ice maker and constitutes the front of the ice maker. The wet compartment includes the ice mold and evaporator and a water distribution tube which applies water over the mold. The trough formed in the bottom panel of the ice maker collects the water that passes over the mold without freezing. The bottom panel thus performs the dual functions of defining the bottom of the ice maker and serving as the water trough. The water trough leads beneath the dividing panel into a reservoir in the dry compartment also formed into the base panel. The water is then recirculated by the water pump to the water distribution tube in the top of the wet compartment and is again directed over the mold. It is an advantage of the invention that only the components of the ice maker that must necessarily be exposed to the water in the ice making process are located in the wet compartment. The dry area shelters the other components from the corrosive effects of the splashing water and high humidity that are inherent in the ice making process.

With the exception of the base panel, the plastic panels are formed by a blowmolding process. A mold of the desired shape is first constructed. Plastic is introduced into the mold, and then pressurized gas is applied to the mold interior. The pressure forces the plastic onto the mold surface where it is allowed to cool, thus taking the shape of the mold. Blowmolding allows relatively complex features to be inexpensively and accurately formed in the panels.

The ice maker includes a side panel that contains a molded-in fan shroud. This allows the fan to be situated onto the face of that panel without the additional prior art step of attaching a shroud to a panel. The ice maker includes an opposite side panel that contains a molded-in access door frame. The frame receives an access door which may be removed so that the interior of the ice cube maker may be reached for servicing. The access door is located in the side panel so that it opens into the dry compartment of the ice maker. The dividing panel contains an additional opening which allows the electronics to be accessed from the wet compartment through a slide-out drawer, as further explained below.

The dividing panel contains molded-in openings which allow the evaporator tubes to be passed between the wet and dry compartments so that the refrigerant can pass between the evaporator and the compressor parts of the refrigeration circuit. While the means for applying water to the mold are located in the wet compartment, the openings in the dividing panel allow the water pump which recirculates the water to be located in the dry compartment.

In the preferred embodiment, the bottom panel is rotocast to allow for the production of relatively complex features during the manufacturing stage. The water trough is molded into the bottom panel with a shape and location directly under the ice mold to collect water that drips over the mold for recycling through a water pump to the mold. An edge of the trough serves as a deflector shield for the ice cubes when they are harvested from the mold. The ice cubes will strike the trough and then continue falling into the ice storage bin. This initial deflection slows down the rate of fall of the ice cubes and insures that, after the initial deflection, the cubes will fall directly into the bin instead of bouncing around the interior of the ice cube maker. The molding of the water trough into the bottom panel reduces manufacturing costs and simplifies the design.

The electronics are housed in an enclosure contained in the dry compartment and are thus safely protected from the corrosive effects of splashing water and humidity. The enclosure may be accessed through an opening in the center dividing panel; the enclosure acts as a sliding drawer and the electronics thus may be serviced from the front of the ice maker. Control switches are located on the drawer front of the electronics enclosure so that they may be accessed from the front of the ice maker. Instructions for the ice maker and the use of the control switches are molded into the center dividing panel adjacent to the electronics enclosure in close proximity to the control switches themselves. Therefore, the instructors are formed as part of the molding process rather than requiring a separate application step, and they cannot be rendered illegible by wear. Some of the electronics enclosure may also be accessed through the access door in the side panel described above.

The panels contain molded-in "blind holes" to accept fasteners such as screws. The panels are constructed of two layers of plastic separated from each other by an airspace. A blind hold is an indentation formed in one of the plastic layers to result a cavity which may accept a threaded or other fastener. The depth of the blind hole may be up to the distance between the two panel layers. The blind holes allow for fasteners such as screws to contact a panel for the entire depth of the hole. Screwing the fastener deeper into the hole progressively increases the strength of the attachment. A blind hole may be contrasted with a simple through-hole which is formed by merely puncturing one of plastic layers. The mating surface of such a hole is limited by the thickness of the panel and the threads are likely to strip after repeated use. The threads of a blind hole are much less apt to strip and therefore the reliability and longevity of the ice maker is improved. The fasteners that attach the often-removed front panel of the ice cube maker to the side panels engage threaded metal inserts fitted into blind holes formed in the panels for extra strength and durability. These inserts may be blowmolded into the panels for a permanent and durable installation that is integral with the blow molding step.

The bottom panel, side panels, and dividing panel are permanently joined together by thermoplastic unicore welding. The dividing panel has a tongue connector along its bottom edge which is slid into a groove connector in the bottom panel. Similarly, the dividing panel has tongue connectors which mate with groove connectors on the side panels. A "unicore," as described in U.S. Pat. No. 5,407,520 is situated between the tongue and groove connections. The unicore consists of a thermoplastic rope with stainless steel resistance wires embedded in the rope near its surface. To weld the panels together, electric current is passed through the wires embedded in the unicore rope. The wires heat uniformly throughout the length of the unicore rope, and thus heat the rope and the surrounding tongue and groove connections. When sufficient heat is generated, the heat and the pressure of the connections allow the molecular chains in the panels to diffuse across the interface and intermingle, forming a secure molecular bond. Properly formed, this bond has at least the same strength and durability as the plastic from which each panel is constructed. The bond is also completely and permanently waterproof and airtight.

The present invention describes one ice cube maker which may be used either by itself or with one or more other ice cube makers of the same design. When only one ice cube maker is used, it is placed directly over the ice cube storage bin, with the top panel of the ice cube maker fastened over the side panels. If another ice cube maker is used, the top panel of the first ice cube maker is removed. The base of the second ice cube maker is placed on top of the first ice cube maker and serves as the top of the first ice cube maker. More specifically, a ridge formed in the top of the center dividing panel of the lower ice cube maker fits into a groove formed in the bottom of the base panel of the upper ice cube maker so that a quick and easy yet secure connection is formed. The first ice cube maker and second ice cube maker independently manufacture ice and deposit cubes into the storage bin. Several ice cube makers may be stacked together as necessary to satisfy the user's ice requirements. While the ice cube makers operate independently in this modular fashion, they all are connected to the means for sensing the ice level in the storage bin so that the ice bin will not be overfilled.

DETAILED DESCRIPTION OF THE INVENTION

Figure 3:
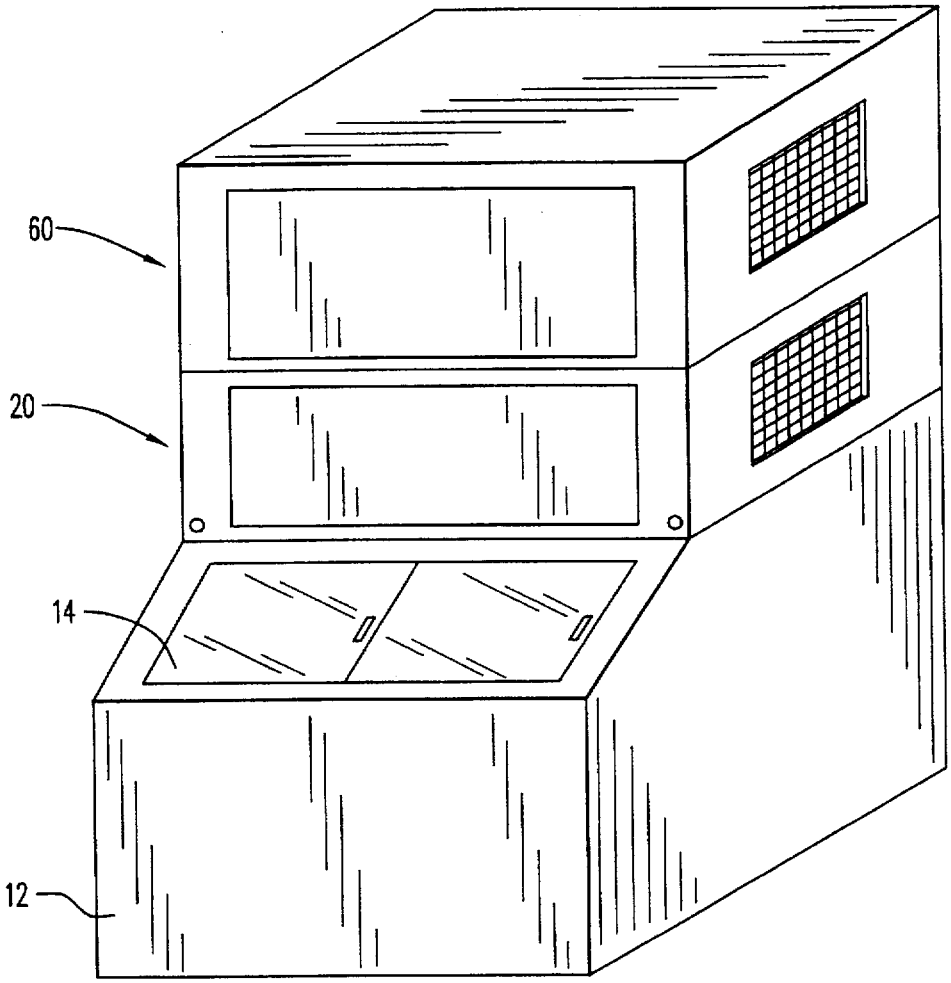
FIG. 3 is a perspective view of two of the present inventions operating simultaneously along with an ice storage bin.

FIG. 3 shows a complete ice making system including a storage bin 12, first ice cube maker 20, and second ice cube maker 60. The two ice cube makers 20 and 60 are shown as an example only; if desired, one ice cube maker may be used alone or more than two ice cube makers may be used. The two ice cube makers 20 and 60 shown here are substantially identical. However, the top unit 60 has a cover panel and the bottom unit 20 does not. The top unit 60 instead functions as the cover for the bottom unit 20. The storage bin 12 has an access door 14 through which ice cubes may be collected by a user. The storage bin 12 is insulated but is not refrigerated, so the ice cubes will slowly melt and will not freeze to one another.

Figure 1:
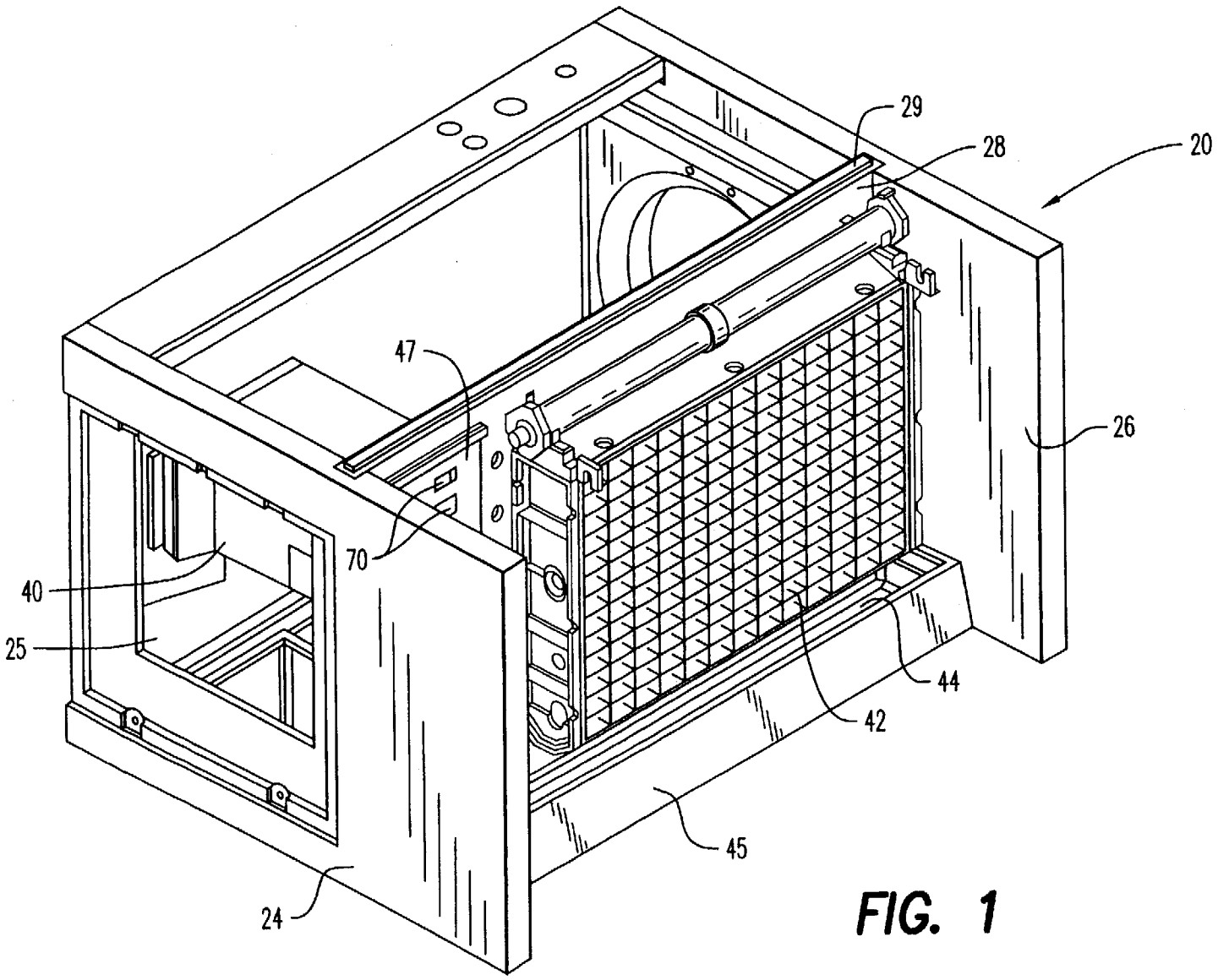
FIG. 1 is a perspective view of the present invention.
Figure 2:
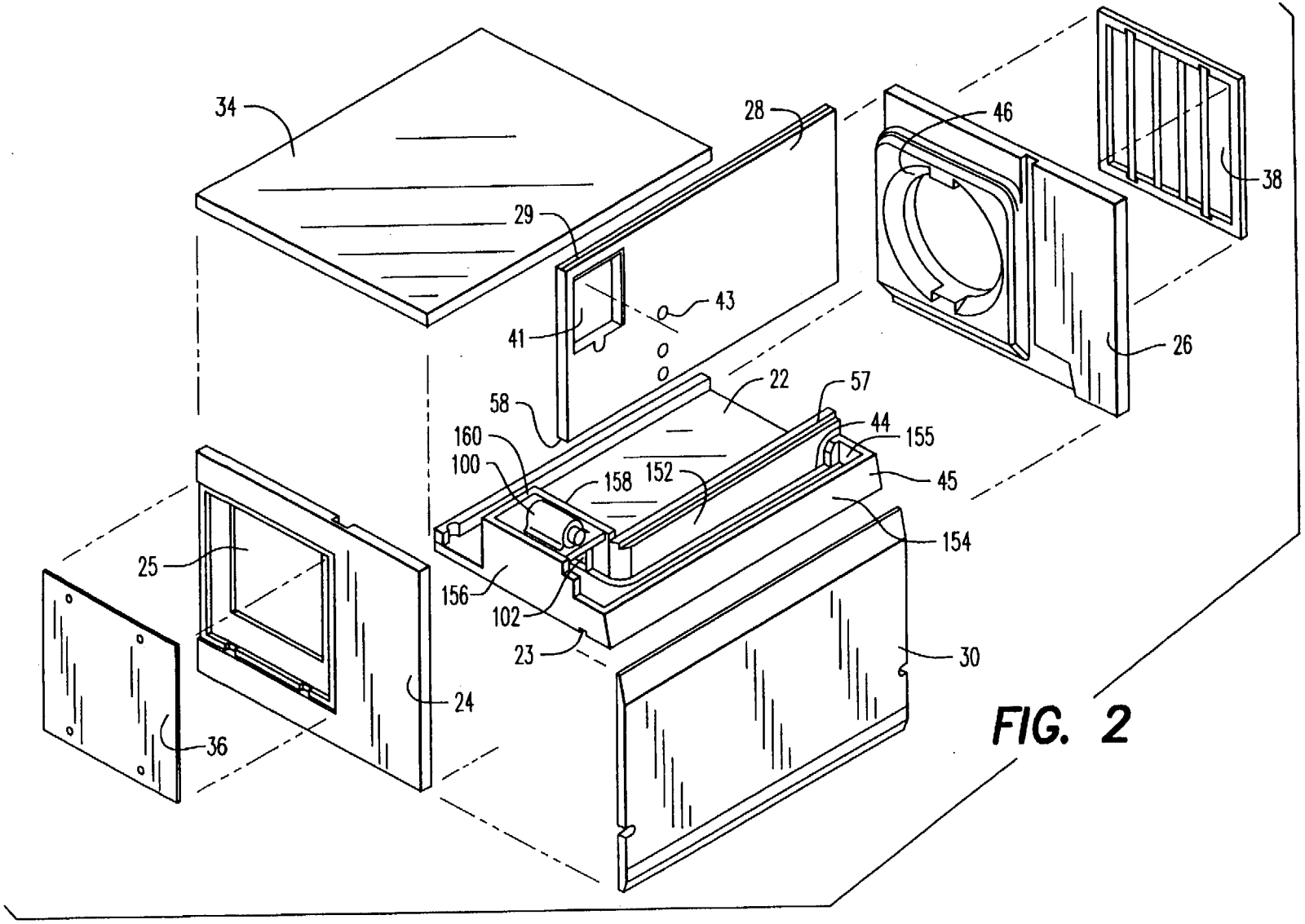
FIG. 2 is an exploded view of the present invention.

FIGS. 1 and 2 show a perspective view of the assembled ice cube maker 20 and a partially exploded perspective view of the ice cube maker 20, respectively. In the preferred embodiment of the invention, the ice cube maker 20 is bounded by several exterior plastic panels. Specifically, the ice cube maker 20 has a base unit 22, two side panels 24 and 26, and a front panel 30. If configured as a single unit rather than one of several stacked units or configured as the top unit of several stacked units, the ice cube maker 20 also includes a top panel 34. The ice cube maker 20 is divided into two interior compartments by a dividing panel 28. The compartment partially bounded by the front panel 30 may be termed the "wet" compartment, and the opposite compartment may be termed the "dry" compartment.

Figure 6:
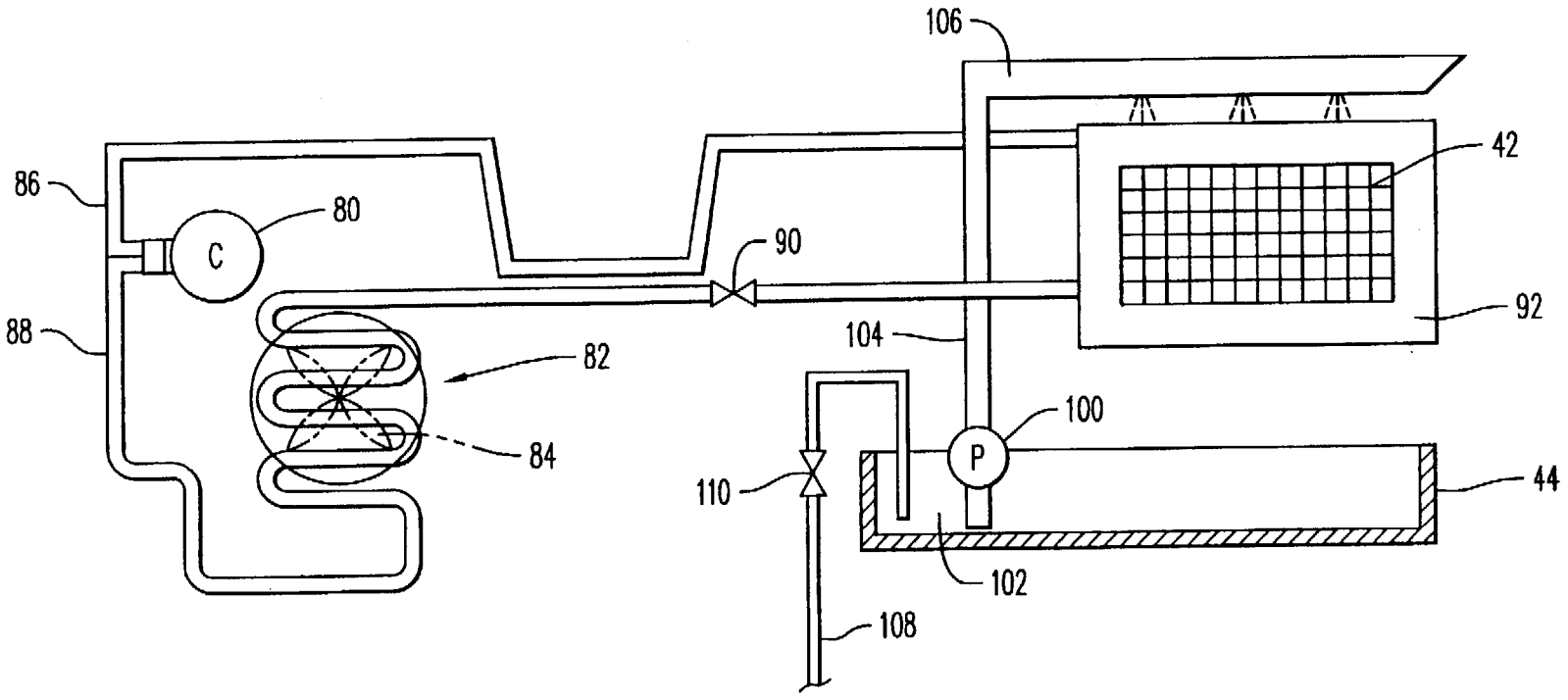
FIG. 6 is a schematic view of the refrigeration circuit and the water cycle of the present invention.

The dry compartment contains most of the refrigeration circuit that is used to cool the water which becomes ice. The components of the refrigeration circuit are schematically depicted in FIG. 6. The refrigeration circuit includes a compressor 80, a condenser 82 and a cooling fan 84. The compressor 80 has a suction line 86 and a discharge line 88. The discharge line 88 leads to the condenser 82 that condenses the compressed refrigerant vapor that comes from the compressor 80. In a preferred embodiment, condensing is accomplished by using a cooling fan 84 to blow air from outside the ice maker 20 over the condenser 82. When the refrigeration circuit is operating in a cooling mode, the condenser 82 leads to an expansion valve 90 which lowers the pressure, and thus the temperature, of the refrigerant. The evaporator 92 lies past the expansion valve 90 and is cooled by the expanded refrigerant. The evaporator 92 is thermally coupled with an ice making mold 42. The refrigerant returns to the compressor 80 through the suction line 86, which completes the refrigeration circuit. The refrigeration circuit components are substantially in the dry compartment with the exception of the evaporator 92 and ice making mold 42 which are in the wet compartment. The refrigeration circuit may also operate in a heating mode, known as a hot gas defrost cycle. In the heating mode, the refrigerant is allowed to pass through a valve leading from the compressor 80 to the evaporator 92, so that the condenser 82 and expansion valve 90 are bypassed. This warms the evaporator 92 and slightly melts the ice in the ice making mold 42 to allow the ice to drop free of the mold in the manner described below. It should be apparent that the refrigeration circuit is a sealed system so that the refrigerant does not escape into the surrounding atmosphere in quantities that are significant to affect the operation of the ice cube maker 20.

The base unit 22 is one of the principal structural members of the ice maker 20, along with the side panels 24 and 26 and the dividing panel 28. These elements are permanently interconnected by a welding process described below to produce the configuration shown in FIG. 1. The lower edge 58 of the dividing panel 28 is attached to the top edge 57 of the water trough collecting portion rear wall 152, extends across the channel establishing fluid communication between the collecting portion and reservoir portion 102 of the water trough 44, and attaches to the outer wall 156 of the reservoir portion 102. Each end of the dividing panel 28 is welded to the corresponding end panel 24 or 26 along the vertical edge of the dividing panel 28 to complete the basic structural unit. The end panels 24 and 26 may also be welded to the base unit 22 to impart additional structural integrity if desired. The top panel 34 and front panel 30 are not welded to the basic structural unit, but are instead removably attached with fasteners in the manner described below.

Water is transported through the ice cube maker as depicted in the schematic drawing of FIG. 6. Water is stored in a reservoir 102 formed by the water trough 44 that is molded into the base panel 22, which extends from the wet compartment under the dividing panel 28 and into the dry compartment of the ice maker 20 as described in more detail below. A water pump 100 located in or in fluid communication with the reservoir 102 circulates water from the reservoir 102 through conduit 104 to a water distribution tube 106 in the wet compartment. The bottom of the water distribution tube 106 is punctured or otherwise open so that gravity directs the water from the water distribution tube 106 over the ice making mold 42. Some of the water freezes to the mold 42 as ice and the rest of the water drips over the mold 42 into the water trough 44. The cycle is completed by the pump 100 then drawing the water out of the reservoir 102 formed by the water trough 44. As the ice cube maker 20 turns water into ice, the water supply of the ice maker 20 is replenished by bringing water from an outside source 108 through a valve 110 and into the reservoir 102. A water level detector (not shown) in the reservoir controls the operation of the valve 110 so that the reservoir 102 remains filled with sufficient water.

The control electronics of the ice maker 20 control the operation of the ice maker, including shifting the refrigeration circuit between its cooling and heating modes, drawing water into the machine as needed and circulating the water through the machine, and suspending operation when the ice storage bin 12 is full. The control electronics are located in an enclosure 40 formed as a drawer slidably mounted within a drawer enclosure housed in the dry compartment (see FIG. 1). The front 47 of the enclosure 40 abuts an opening 41 (see FIG. 2) in the dividing panel 28 so that the enclosure 40 may be slid through the dividing panel 28, allowing access to the electronics from the wet compartment. Control switches 70 are located on the front 47 of the enclosure 40 and are accessible from the wet compartment. To access the wet compartment, the front panel 30 is removed from the side panels 24 and 26. This is accomplished by removing two fasteners that connect the front panel 30 with the side panels 24 and 26. One fastener extends through the front panel 30 near the middle of a vertical edge of the front panel 30 and mates with a hole in side panel 24. Another fastener extends through the front cover 30 near the middle of the opposite vertical edge and mates with a hole in side panel 26. The fasteners and mating holes in the panels are described in more detail below.

The ice cubes are formed in the wet compartment in the ice cube mold 42. The mold 42 includes a metallic plate welded to the evaporator 92 (see FIG. 6), and an array of metal sheets extending vertically and horizontally from the plate which form the individual compartments wherein the ice cubes are formed (see FIG. 1). The metallurgical connections between the evaporator 92 and the metallic plate and compartments of the mold 42 provide good thermal conduction between the refrigerant and the individual compartments.

When the refrigerant cycle is in its cooling mode, water drips from the water distribution tube 106 over the mold 42. Ice cubes are formed as water drips over the chilled individual compartments of the mold 42. However, not all of the water passing over the mold 42 freezes in each pass. The water which does not freeze to the mold 42 collects in a water trough 44 which is integrally formed into the base panel 22. By "integrally formed" it is meant that the trough is cast into the panel when the panel is formed in a mold. This reduces a manufacturing step that would otherwise be necessary. If the water trough 44 were not integrally molded into the base panel 22, it would have to be formed afterwards and then attached to the base or other structure of the machine in a separate manufacturing step. A water trough that is not a physical part of the base panel could be used instead.

The water trough 44 carries water from the wet compartment to the dry compartment. The water trough 44 includes a collecting portion in the wet compartment which collects water dripping from the mold 42 and a reservoir portion 102 in communication with the collecting portion and extending from the wet compartment, under the dividing panel 28, and into the dry compartment, as best seen in FIG. 2.

The collecting portion is defined by a rear wall 152 and a front wall 154 with the collecting trough therebetween. The rear wall 152 and front wall 154 are connected by an end wall 155. The reservoir portion 102 includes an outer wall 156 and an inner wall 158 connected by a rear wall 160. Communication between the collecting portion and reservoir portion 102 of the water trough 44 is established by connecting the front of the reservoir portion 102 inner wall 158 to the end of the collecting portion rear wall 152 and connecting the front of the reservoir portion 102 outer wall 156 to the end of the collecting portion front wall 154, and using a continuous bottom through both portions. This "connecting" of the walls is not a separate manufacturing step, but simply describes the integral design of the trough 44 and is accomplished in the process of molding the base unit 22. The bottom of the trough 44 may be sloped to facilitate the flow of water from the collecting portion to the reservoir portion 102 of the trough 44 or pumping.

The dividing panel 28 is attached to the base unit 22 along the collecting portion rear wall 152 which runs across the base unit 22 from side panel 26 towards side panel 24. The collecting portion rear wall 152 does not extend completely to side panel 24, but instead stops short of side panel 24 to define the channel between the collecting portion and the reservoir portion 102. It is thus appreciated that the reservoir portion 102 is located in the dry compartment of the ice maker, the collecting portion is located in the wet portion, and the dividing panel 28 divides one from the other with the above-described channel maintaining them in fluid communication with one another. From the reservoir, the water is pumped by a water pump 100 through conduit 104 towards the top of the ice maker 20 and into the water distribution tube 106.

It is an advantage of the invention that the wet compartment contains only the components that must be exposed to the moisture and humidity produced as water splashes over the mold 42. The reservoir portion 102 of the water trough 44 is covered by the housing of the water pump 100 so that water will not leak from the reservoir 102 into the remainder of the dry compartment. The outlet of the water pump 100 passes from the reservoir portion 102 of the water pump 100 beneath the dividing panel 28, where it connects to conduit 104 that leads to the water distribution tube 106. This arrangement keeps the dry compartment completely sealed from water and the high humidity of the wet compartment. This increases the useful service life of the ice maker 20 and reduces damage to parts resulting from splashing water or humidity.

The two side panels 24 and 26, the top panel 34, and the center dividing panel 28 are preferably manufactured by blowmolding, in which a mold of the desired shape for each panel is constructed, plastic is introduced into the molds, and pressurized gas is then applied to force the molten plastic to the mold surfaces. Blowmolding allows the ice maker 20 panels to be inexpensively manufactured, yet to be accurately formed. In a preferred embodiment, the base unit 22 is rotocast instead of blowmolded. Rotocasting is a well known process similar to blowmolding except that plastic is forced onto the edges of the mold by centripetal force generated by rotating the mold instead of gas pressure. Rotocasting is often more effective than blowmolding for larger and more robust plastic components. However, good results may also be obtained when the base panel 22 is blowmolded and that is an alternate design.

A variety of features are blowmolded into the panels, which eliminates the manufacturing steps of modifying the panels that would otherwise be necessary. One side panel 24 contains a blowmolded access opening 25 into the dry compartment. Access door 36 secures to this opening 25 for normal operations, and it may be removed to service the machine. The access opening 25 is located towards the rear of the machine so that it provides access to the dry compartment. Access to the wet compartment is obtained by simply removing the front panel 30. (It is generally not convenient to routinely access the dry compartment from the back of the ice cube maker since ice cube makers are commonly operated with their backs adjacent or nearly adjacent to a wall.)

The dividing panel 28 contains a plurality of blowmolded openings, including an opening 41 which allows the electronics enclosure 40 to be reached from the front of the ice cube maker. The sliding drawer of the enclosure 40 may be slid through the dividing panel 28 as hereinabove described. Switches 70 for the control electronics are mounted on the front 47 of the enclosure 40 to control the operation of the machine. Instructions for operating the switches 70 are molded into the dividing panel 28 adjacent to the enclosure opening 41. These instructions can be in any level of detail and in any language or other system of communication, such as pictures, that is desired. The close proximity of the instructions to the switches 70 helps to reduce operator error and confusion. The instructions will always be accessible to the user and will not wear away or otherwise become illegible over time as they might if they were merely painted or otherwise applied to the surface of the panel 28. Because they are formed as part of the molding process, no separate step of applying them to the panel is necessary.

The center dividing panel 28 contains holes such as hole 43 shown in FIG. 2 for passing conduit between the wet and dry compartments. Specifically, the suction line 86 and the line between the condenser 82 and the evaporator 92 must pass between the wet and dry compartments.

Another feature of the present invention is a molded-in fan shroud 46 as shown in FIG. 2. The shroud 46 shrouds a fan 84 (see FIG. 6) that cools the condenser 82 by blowing air over it. The shroud 46 is integrally molded into the side panel 26 during the molding process. As with the molded-in water trough 44, this has the advantage of eliminating a separate manufacturing step. Without the advantage of a molded-in shroud 46, a separate shroud would have to be attached to the side panel 26 after the side panel 26 was formed. The elimination of the step of attaching a fan shroud into the side panel 26 simplifies the manufacturing process, saves time, and reduces waste of material. A grille 38 covers the fan 84 to protect the fan 84 from damage and for safety.

The ice maker panels contain blowmolded "blind holes" which allow the panels to be strongly and reliably connected to each other. A sectional view of a representative blind hole 51 in a panel is provided in the left-most portion of FIG. 4. One layer of the double layered plastic panel has a cavity so that a fastener such as a screw 70 may be fitted into the hole. The panel to which the panel with the blind hole is attached has a through-hole 52. Before entering the blind hole 51, the screw 70 passes through the through-hole 52 formed in the panel which is to be joined with the panel containing the blind hole 51. The through-hole 52 is a molded-in sleeve which connects two holes formed in opposite layers of the plastic panel. In a preferred embodiment, the through-hole 52 and blind hole 51 are sized and threaded so that they will accept a standard sized screw. Note that the blind hole 51 extends into the panel and forms a closed surface therein. The extension into the panel gives the hole more threaded surface area which the screw 70 may engage. The threads of the hole are very difficult to strip or to otherwise damage, and hence the panel containing the hole is very durable. "Blind hole" mating may also be used to connect single layered metal or plastic parts to the plastic panels; in this case, the plastic sleeve through-hole 52 is not be present.

In a double layered panel, the simple alternative to the sleeve through-hole 52 is two simple through-holes, one in each layer of a plastic panel. The sleeve through-hole 52 allows for more contact, hence a stronger connection, with a fastener than do simple through-holes. The blind hole 51 and through-hole 52 may be compared with a typical simple through-hole 53 that is only as deep as the thickness of one of the plastic layers, as shown in the center portion of FIG. 4. This hole 53 has less surface area to contact a fastener 72 and is therefore weaker. The simple hole 53 does not terminate at a closed ending; instead, it opens into the interior of a panel. If a fastener such as a screw 72 were placed in a simple hole 53, the screw 72 could continue to rotate even after all the screw 72 is fully fastened. This allows the thread of the hole 53 to become stripped more easily then the threads in blind hole 51, which is a serious problem as there is no easy way to rethread the panel in the same location with the same size hole. Further, the use of simple through-holes does not produce a secure attachment, even before the hole threads are stripped, because the tightening of the screw tends to bow the two layers of the panel together.

Blind holes and fasteners as described above are used to attach panels together and to attach other components to the panels in the present invention. Specifically, the top panel 34 attaches to both side panels 24 and 26 by fasteners engaged with blind holes. The top panel 34 contains four through-holes of the type described above proximate each of its four corners. The two side panels 24 and 26 each contain two blind holes on their top edges so that the top panel 34 to can be placed over the two side panels to allow the through-holes of the top panel 34 to align with the blind holes of the side panels 24 and 26. Fasteners, preferably self-threading screws, are inserted through the through-holes of the top panel 34 into the blind holes of side panels 24 and 26 and tightened.

The access plate 36 attaches to the side panel 24 and the fan grille 38 attaches to the side panel 26 with self-threading screws in blind holes. One through-hole near each corner of the access plate 36 aligns with four blind holes located near the corners of the access plate frame 25 to receive the screws. The fan grille 38 attaches similarly.

Figure 4:
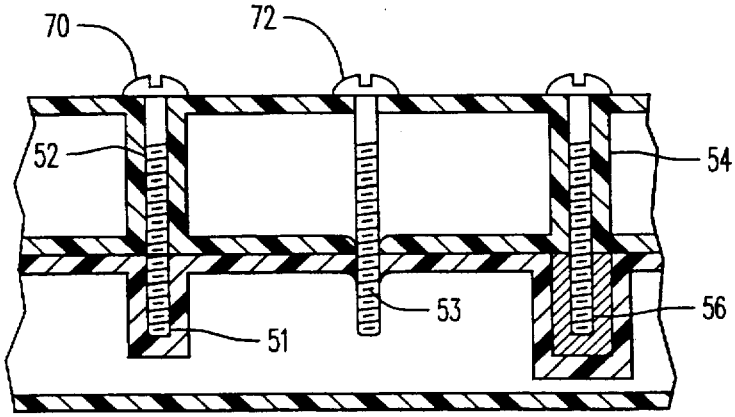
FIG. 4 is a detail view of a blind hole connection used to connect some of the elements of the present invention shown along with other possible connections.

In a preferred embodiment of the invention, the front panel 30 attaches to the side panels 24 and 26 with threaded fasteners that fit through sleeves molded into the front panel 30, and into threaded metal inserts that are molded into the side panels 24 and 26. The sleeves are essentially the same as the sleeves with through-holes described above; they are molded-in sleeves integral with the panel which connect holes in each of the two panel layers. The metal inserts are similar to the blind holes discussed above, except that the metal components are more durable than their plastic equivalents. With reference to FIG. 4, a representative sleeve 54 and metal insert 56 are depicted. The metal insert 56 is essentially a hollow sleeve with one end capped. The insert 56 is preferably threaded so that it may accept a standard sized screw. The inserts may be placed in the mold from which the side panels 24 and 26 are cast so that no separate step of installing them in the panel is required. Each metal insert is surrounded by the portion of the plastic panel in which the insert fits so that the insert and the panel are reliably attached. The additional durability of the inserts is advantageously used to connect the front panel since the front panel 30 must be removed more often than the other panels. However, the use of molded-in plastic through-holes and blind holes to attach the front panel 30 also yields good results and is an alternate design.

The center dividing panel 28 is welded on its bottom to the base panel 22, on one side to side panel 26, and on the other side to side panel 24, as explained below. Welds are used instead of the through-holes and blind holes used elsewhere for several reasons. Unlike the other panels, the dividing panel 28, side panels 24 and 26, and base panel 22 form the structural body of the ice maker and need never be removed from each other. Also, welding produces a connection that is stronger and more impervious to water and humid air than can be obtained from screws or similar discrete fasteners. Since a purpose of the center dividing panel 28 is to separate the dry compartment from the wet compartment, it is important that the connection be water-tight. Otherwise, water could splash or leak from the wet compartment into the dry compartment. The increased strength obtained by welding is useful since the ice maker 20 is designed to be used so that one ice maker may be positioned atop another. The top ice maker 60 is supported primarily by the center dividing panel 28, so that panel must have a high load bearing capability.

Figure 5:
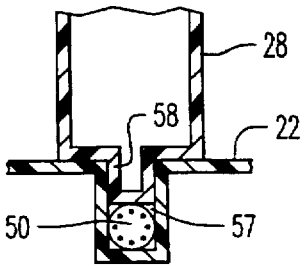
FIG. 5 is a detail view of a tongue and groove connection along with the unicore welding element that is used to join some of the components of the present invention.

In a preferred embodiment, the bottom panel 22, side panels 24 and 26, and dividing panel 28 are welded using a thermoplastic unicore. The unicore welding process may be understood with reference to FIG. 5. The dividing panel 28 has a tongue 58 along its bottom edge which is slid into a groove 57 in the raised ridge rear wall 152 of the base unit 22. With reference to FIG. 1, the groove 57 extends from side panel 26 towards side panel 24, and terminates before it reaches side panel 24 so that the water channel may pass beneath the dividing panel 28. A unicore welding element 50 is situated in groove 57 (see FIG. 5). The unicore welding element 50 consists of a thermoplastic rope with stainless steel resistance wires embedded in the rope near its surface. To weld the panels together, electric current is passed through the resistance wires. The wires heat uniformly throughout the length of the welding element 50, and thus heat the rope and the surrounding tongue and groove connection. When sufficient heat is generated, the heat and the pressure of the connections allow molecular chains in the two panels to diffuse across the connection interface and intermingle, forming a secure molecular bond. Properly formed, this bond has at least the same strength and durability as the plastic from which each panel is constructed. The bond will also be completely and permanently waterproof and airtight. This thermoplastic welding technique is described in more detail in above-mentioned U.S. Pat. No. 5,407,520, the contents of which are hereby incorporated by reference. Alternatively, the panels may be permanently joined by more conventional techniques, such as adhesive or fasteners.

The dividing panel 28 has a similar tongue on both of its vertical edges that mate with grooves on the side panels 24 and 26. Unicore elements in these grooves allow the dividing panel 28 to be welded to the side panels 24 and 26.

The ice cube maker 20 is manufactured by first producing the various panels by the blowmolding and rotocast molding processes described above. Those processes preferably include the production of the through-holes, blind holes and metal insert holes described above to facilitate the assembly of the panels. The basic structural unit is then assembled by attaching the base unit 22 and the side panels 24 and 26 to the dividing panel 28, preferably by the unicore welding technique described herein. That basic structural unit can then receive the refrigeration components including the refrigeration circuit (see FIG. 6) and the electronics enclosure 40 and necessary electrical wiring. The unit is then ready for enclosure by attachment of the side panel access door 36 and fan grill 38 by using self-threading screws extending through the various through-holes and threaded into the various blind holes. The front panel 30 is attached by using screws extending through through-holes and into the mating threaded metal inserts fitted into the side panels 24 and 26. If the unit is to be used without a complementary unit positioned over it as described above, the top panel 34 is attached using self-threading screws extending through the several through-holes in the top panel 34 and into mating blind holes in the side panels 24 and 26.

Once assembled, the operation of the ice cube maker is conventional in the art. A freezing cycle begins with the cycling of refrigerant through the compressor 80 and past the condenser 82. The refrigerant then flows through the expansion valve 90 and expands and cools, and the cooled refrigerant cools the evaporator 92 and associated ice mold 42. The refrigerant then returns to the compressor 80. Water is continuously pumped by pump 100 from the reservoir 102 of the trough 44 to the water distribution tube 106. It flows from the water distribution tube 106 over the ice mold 42 and some of it freezes in the ice mold 42. The water that does not freeze in the ice mold 42 drips over and off the ice mold 42 and into the trough 44 for return to the water distribution tube 106 via the conduit 104. Additional water is supplied as needed through the valve 110.

The ice cube maker 20 may initiate the harvesting cycle using any of the means known in the prior art, such as by measuring the temperature of the mold 42 or by measuring the depletion of the water in the reservoir 102. The control electronics of the ice maker process the data provided by sensors and determine when harvesting should be initiated. In a preferred embodiment, harvesting is accomplished by initiating a hot gas discharge as previously described. The compressed, heated refrigerant passes through the evaporator 92 and warms the mold 42, causing the ice cubes contained therein to melt slightly. A mechanical pusher may also be incorporated which pushes the ice out of the mold 42 after the heating step in the manner shown in the art. The individual compartments of the mold 42 slope downwards towards the storage bin 12 so that the cubes will fall from the mold 42 once they are no longer frozen to it. The front wall 45 of the water trough 44 collection portion slopes downward and forward so that the cubes deflect off its bottom front edge 45 into the storage bin 12. The width of the water trough 44 is sufficiently narrow and the location of the trough opening is such to prevent the ice cubes from entering the trough 44 itself. The deflection of the cubes against the water trough 44 slows their descent and guides the cubes into the bin 12. While the deflection is useful when only one ice making unit is being used, it is a more significant advantage when a plurality of ice cube making units are being used together, as described below.

The ice making process repeats until the ice in the storage bin 12 reaches a predefined level, at which time a signal is sent to the control electronics of the ice maker 20 to suspend the ice making process. The ice maker 20 may detect the ice level in storage bin 12 by any means known in the prior art, such as an ultrasonic ranging device, a mechanical probe or probes, or the use of doors. The ice maker 20 detects when the ice level in storage bin 12 has been reduced to a second predefined level and sends a signal to the control electronics of the ice maker 20 to resume the ice making process.

Two or more ice cube makers may be combined in a modular arrangement if one ice cube maker will not produce an amount of ice sufficient to meet a user's needs. A groove 23' in the bottom of the base panel 22' of one ice maker 60 may be fitted around a tongue 29 formed in the top of the center dividing panel 28 of another ice maker 20 (see FIG. 2), where 22' and 23' represent similar parts of ice cube maker 60 as are located on described ice maker 20. The modules are substantially identical, so an individual module may be used either above or beneath another module, or may be used between two other modules. The weight of the top ice making module 60 along with the ridge and groove produces a sufficiently strong connection so that no other connections need be made. However, if desired for additional stability, this connection could be secured by additional means.

Each ice making module connects to an ice level sensor so that the bin 12 will not be overfilled. The relationship between the location of the ice mold 42 and the front edge 45 of the water trough 44 allows the ice cubes to be harvested from an upper module without interfering with the operation of a lower module. As noted previously, the front edge 45 of the water trough 44 slopes down and forward.

When cubes are harvested from the mold 42, they strike the front edge 45 of the water trough 44 and deflect towards the front of the ice maker 20. The area between the front edge 45 of the water trough 44 and the front panel 30 of the maker is vacant so that the falling ice cubes will not impact any component of the ice maker 20. Without the deflecting effect of the water trough 44, ice cubes falling from an upper module could fall onto the water distribution tube or ice cube mold of a lower module, which would result in improper harvesting of the falling ice cubes, interference with the ice cube manufacturing of the lower module, or both. Shaping and locating the water trough 44 to serve as a deflector eliminates the need for a separate shield and saves the manufacturing step of installing a separate shield, thereby reducing the cost and increasing the reliability of the ice maker.

What is claimed is:

1. A method of manufacturing an ice maker machine, comprising: producing a plastic dividing panel; producing a plastic base unit; permanently welding the dividing panel onto the base panel whereby the dividing panel divides a first compartment from a second compartment; installing an ice mold in said first compartment; installing electronic controls, a compressor, a fan and a condenser in said second compartment; and at least partially enclosing the first compartment and second compartment with a plurality of enclosure panels.

2. The method of claim 1, wherein said welding step includes positioning a thermoplastic rope between the dividing panel and the base panel, the thermoplastic rope containing an electrically conductive element therethrough, and applying a current through the conductive element to fuse together the dividing panel, thermoplastic rope and base panel.

3. The method of claim 2, wherein the welding step produces a liquid tight attachment between the dividing panel and the base panel.

4. The method of claim 2, further comprising producing a first plastic end panel and a second plastic end panel, and permanently welding the first plastic end panel to a first end of the base panel and permanently welding the second plastic end panel to a second end of the base panel opposite the first end of the base panel.

5. The method of claim 4, further comprising permanently welding the first end panel to a first end of the dividing panel and permanently welding the second end panel to a second end of the dividing panel opposite the first end of the dividing panel, whereby the base panel and dividing panel are welded together to the first end of the base panel and dividing panel and the second end panel is welded to the second end of the base panel and dividing panel.

6. The method of claim 4, wherein said step of welding the first end panel includes positioning a thermoplastic rope between the first end panel and the first end of the base panel, the thermoplastic rope containing an electrically conductive element therethrough, and applying a current through the conductive element to fuse together the first end panel, thermoplastic rope and base panel.

7. The method of claim 6, wherein the dividing panel includes a substantially vertical surface and the ice mold is attached to said substantially vertical surface.

8. The method of claim 7, wherein the base panel includes a water trough positioned below the ice mold, the water trough being integral with the base panel.

9. The method of claim 1, further comprising producing a detachable panel with at least two layers and attaching said detachable panel, the fastener blind hole having a diameter to receive a fastener, and further comprising attaching the detachable panel by inserting a fastener through a fastener hole sleeve in the detachable panel.

10. The method of claim 9, wherein the first end panel includes a blind hole, the blind hole having a durable sleeve to threadably receive the fastener, the durable sleeve being molded into and of the same material as the first end panel.

11. The method of claim 10, wherein the first end panel is a thermoplastic material, and the durable sleeve is metal.

12. A method of manufacturing an ice making machine, comprising: molding a substantially unitary plastic base unit including a water trough; producing a water freezing member including an evaporator and ice mold; producing a plastic dividing panel; attaching the dividing panel to the base unit and mounting the freezing member to the dividing panel whereby the freezing member is positioned vertically above the trough so that water flowing over the freezing member drops into the trough.

13. The method of claim 12, wherein the trough includes a front portion positioned beneath the dividing panel and a side portion extending from the front portion to under the dividing panel.

14. The method of claim 13, further comprising mounting a top to the side portion to cover the side portion.

15. A method of producing an ice making and storage assembly, comprising: producing a first ice maker and a second ice maker, each of the first ice maker and second ice maker including a plastic unitary base unit including an upper surface with an integral water trough and a lower surface with an integral mount; a plastic dividing panel to divide a first compartment from a second compartment, the dividing panel having a lower portion permanently attached to the base unit and an upper portion with a mating mount, the first compartment including an ice mold and the second compartment including electronic controls, a compressor, a condenser and a fan; producing an ice storage bin; stacking the first ice maker onto the storage bin; and stacking the second ice maker onto the first ice maker by mating the mount of the second ice maker with the mating mount of the first ice maker.

16. An ice making machine comprising: a plastic unitary base unit having an upper surface with an integral water trough; a plastic dividing panel dividing a first compartment from a second compartment, the dividing panel having a lower portion permanently attached to the base unit, a first end, and a second end opposite the first end; a freezing member in the first compartment, the freezing member including an evaporator and an ice mold attached to the evaporator; and control electronics, a compressor, a condenser and a fan in the second compartment.

17. The machine of claim 16, wherein the dividing panel is welded to the base unit with a thermoplastic weld.

18. The machine of claim 17, wherein the dividing panel includes a substantially vertical surface to receive the freezing member and wherein the water trough is positioned in the first compartment includes a first portion beneath the freezing member so that water dripping over the freezing member falls into the water trough.

19. The machine of claim 18, wherein the water trough includes a second portion in fluid communication with the first portion and extending under the dividing panel to the second compartment.

20. The machine of claim 19, further comprising a cover covering the second portion of the water trough to seal the water trough from the second compartment.

21. The machine of claim 20, further comprising a water pump mounted to said cover and in fluid communication with the second portion of the water trough for pumping water from said second portion to the freezing member.

22. The machine of claim 16, wherein the base unit has a lower surface with a mounting member thereon and the dividing panel has an upper edge with a mating mounting surface thereon, whereby a first machine can be stacked on top of a second machine with the mounting member of the first machine mounted on the mating mounting member of the second machine.

23. The machine of claim 22, wherein one of the mounting members and the mating mounting member includes a groove and the other of the mounting member and the mating mounting member includes a tongue.

24. The machine of claim 23, wherein said groove and tongue are integral with the base unit and dividing panel.

25. The machine of claim 16, further comprising a front panel attached to the first and second end.

26. The machine of claim 25, wherein the first panel includes at least two layers, and a set of fastener holes through the two layers, each hole having a sleeve between a first layer side and a second layer side.

27. The machine of claim 26, wherein the first end and second end include a set of blind holes to receive a fastener from the front panel, whereby the front panel is attached to the first end and second end by fasteners extending through the fastener holes in the front panel and threaded into the first end and second end.

28. The machine of claim 27, wherein said blind holes in the first end and second end include threaded sleeves to receive threaded fasteners.

29. The machine of claim 28, wherein the threaded sleeves are integral with the first end and second end.

30. The machine of claim 28, wherein the threaded sleeves are metallic inserts in the first end and second end.

31. The machine of claim 16, wherein said control electronics are in a drawer slidably mounted in a drawer enclosure in the second compartment, the drawer being slidable from a closed position in the enclosure in the second compartment to an open position in the first compartment.

32. The machine of claim 16, wherein one of the first end and second end includes an integral fan shroud and further comprising a fan grill removably mounted on said one of the first end and second end to cover the fan.

33. The machine of claim 32, further comprising a removable access door to access the secured compartment, in the other of the first end and second end.

34. The ice making machine of claim 16, wherein said freezing member is mounted to said dividing panel.

35. An ice making machine, comprising: a base unit; a dividing panel with a lower portion attached to the base unit, the dividing panel dividing a first compartment from a second compartment; an electronic control assembly in the second compartment, the control assembly including an enclosure and a drawer, the drawer being slidably mounted to close in the enclosure in the second compartment and to open into the first compartment.

36. A method of making and storing ice, comprising flowing water over an ice mold in a first ice making machine, the ice mold being a substantially vertical grid mounted to an evaporator, the ice mold and evaporator being mounted to a dividing panel dividing the first ice making machine into a first compartment containing the ice mold and a second compartment; freezing the portion of the water in the ice making mold and dripping unfrozen water past the ice mold into a water trough positioned beneath the ice mold, the trough including a collecting portion bound on a side by a collecting portion wall extending along the collecting portion; releasing ice from the ice mold by heating the ice mold to partially melt the ice and allow the ice to fall by gravity from the ice mold to strike the collecting portion wall to break into desired pieces and then to fall into a storage bin positioned beneath the first ice machine.

37. The method of claim 36, further comprising flowing water from the collecting portion of the water trough to a pumping portion, the pumping portion being in fluid communication with the collecting portion; and pumping water from the pumping portions back to the ice mold to flow over the ice mold.

38. The method of claim 37, further comprising stacking a second ice making machine onto the first ice making machine; making ice in the second ice making machine; and dropping ice from the second ice making machine past the first ice making machine and into the storage bin.

39. The method of claim 36, wherein said first ice making machine further comprises a base panel, said dividing wall being welded to said base panel via a thermoplastic rope which is disposed between said dividing wall and said base panel, said thermoplastic rope containing an electrically conductive element through which a current is applied to fuse together said dividing wall, said thermoplastic rope and said base panel.

* * * * *